US010043443B2

(12) United States Patent
Zhang

(10) Patent No.: US 10,043,443 B2
(45) Date of Patent: Aug. 7, 2018

(54) DISPLAY DEVICE AND METHOD AND APPARATUS FOR COMPENSATING LUMINANCE OF DISPLAY DEVICE

(71) Applicant: BOE TECHNOLOGY GROUP CO., LTD., Beijing (CN)

(72) Inventor: Xiangfei Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 45 days.

(21) Appl. No.: 14/437,169

(22) PCT Filed: Sep. 26, 2014

(86) PCT No.: PCT/CN2014/087599
§ 371 (c)(1),
(2) Date: Apr. 20, 2015

(87) PCT Pub. No.: WO2015/180336
PCT Pub. Date: Dec. 3, 2015

(65) Prior Publication Data

US 2016/0247445 A1 Aug. 25, 2016

(30) Foreign Application Priority Data

May 30, 2014 (CN) ..... 2014 1 0240470

(51) Int. Cl.
*G09G 3/00* (2006.01)
*G09G 3/3225* (2016.01)
(Continued)

(52) U.S. Cl.
CPC ..... *G09G 3/3225* (2013.01); *G09G 3/006* (2013.01); *G09G 3/2003* (2013.01);
(Continued)

(58) Field of Classification Search
None
See application file for complete search history.

(56) References Cited

U.S. PATENT DOCUMENTS 5,517,333 A * 5/1996 Tamura ..... H04N 5/20 348/234
6,040,860 A * 3/2000 Tamura ..... H04N 5/20 348/252
(Continued)

FOREIGN PATENT DOCUMENTS

CN 1435810 A 8/2003
CN 1517960 A 8/2004
(Continued)

OTHER PUBLICATIONS

Feb. 4, 2015—(WO) International Search Report and Written Opinion PCT/CN2014/087599 with Eng Tran.
(Continued)

*Primary Examiner* — William Boddie
*Assistant Examiner* — Bipin Gyawali
(74) *Attorney, Agent, or Firm* — Banner & Witcoff, Ltd.

(57) ABSTRACT

A luminance compensating method and apparatus for a display device is provided. The luminance compensating method for the display device comprises obtaining a list of first luminance compensation information of the display device set in advance; regenerating target luminance compensation information for all pixels of the display device based on the list of the first luminance compensation information; and performing luminance compensation on input image according to the target luminance compensation information for all the pixels of the display device, wherein the list of the first luminance compensation information is set in advance by dividing all the pixels of the display device into groups, calculating average luminance compensation information for each group of pixels based on initial lumi-
(Continued)

nance compensation information of all pixels in this group of pixels, and forming the list of the first luminance compensation information by employing the average luminance compensation information of each group of pixels.

16 Claims, 5 Drawing Sheets

(51) Int. Cl.
*G09G 3/20* (2006.01)
*G09G 3/3208* (2016.01)
*G09G 3/36* (2006.01)

(52) U.S. Cl.
CPC ..... *G09G 3/3208* (2013.01); *G09G 3/3648* (2013.01); *G09G 2300/0443* (2013.01); *G09G 2320/0233* (2013.01); *G09G 2320/0295* (2013.01); *G09G 2320/045* (2013.01); *G09G 2320/0693* (2013.01); *G09G 2360/147* (2013.01)

(56) References Cited

U.S. PATENT DOCUMENTS 6,591,015 B1* 7/2003 Yasunari ..... H04N 19/105 375/240.13
8,014,623 B2* 9/2011 Xie ..... G06T 5/20 382/254
8,497,827 B2 7/2013 Lee
2004/0080631 A1* 4/2004 Tominaga ..... H04N 5/20 348/234
2005/0226526 A1* 10/2005 Mitsunaga ..... H04N 1/3935 382/274
2006/0214940 A1* 9/2006 Kinoshita ..... G09G 3/2096 345/589
2007/0229863 A1* 10/2007 Ono ..... G06T 5/008 358/1.9
2008/0284794 A1 11/2008 Wang et al.
2008/0303754 A1 12/2008 Murata et al.
2008/0304760 A1 12/2008 Lee et al.
2009/0058772 A1 3/2009 Lee
2011/0023464 A1 2/2011 Lee et al.
2011/0115829 A1* 5/2011 Ito ..... G09G 3/3426 345/690
2011/0181500 A1 7/2011 Liao
2011/0234644 A1 9/2011 Park et al.
2012/0154460 A1* 6/2012 Segawa ..... H01L 27/3276 345/690
2012/0176397 A1* 7/2012 Mizukoshi ..... G09G 3/3233 345/589
2013/0027383 A1* 1/2013 Odawara ..... G09G 3/3233 345/212
2014/0071189 A1 3/2014 Park et al.
2014/0152721 A1* 6/2014 Byun ..... G09G 3/3208 345/691
2014/0320042 A1* 10/2014 Yamamoto ..... H05B 33/0896 315/294
2015/0269895 A1* 9/2015 Kao ..... G09G 3/006 345/690
2015/0325170 A1 11/2015 Jeon et al.
2016/0027354 A1* 1/2016 Terai ..... G09G 3/36 345/87

FOREIGN PATENT DOCUMENTS

CN 101640038 A 2/2010
CN 101667418 A 3/2010
CN 101996618 A 3/2011
CN 102025952 A 4/2011
CN 102231016 A 11/2011
CN 102347015 A 2/2012
CN 103489405 A 1/2014
CN 103531175 A 1/2014
CN 103792704 A 5/2014
CN 104021761 A 9/2014
EP 01424672 A1 6/2004
WO 2009002316 A1 12/2008

OTHER PUBLICATIONS

Oct. 7, 2016—U.S. Office Action—U.S. Appl. No. 14/436,967.
Oct. 8, 2015—(CN) Chinese Office Action—App. No. 201410240582.0.
Oct. 8, 2015—(CN) Chinese Office Action—App. No. 201410240582.0 English Transation.
Apr. 26, 2017—U.S. Office Action U.S. Appl. No. 14/436,967.
Feb. 9, 2015—(WO) International Search Report and Written Opinion Appn PCT/CN2014/088689 with English Tran.
Nov. 2, 2017—(EP) Extended European Search Report Appn 14851432.6.
Nov. 30, 2017—(US) Second Office Action U.S. Appl. No. 14/436,967.
Nov. 13, 2017—(EP) Extended European Search Report Appn 14853155.1.
Jan. 8, 2015—(CN) First Office Action Appn 201410240470.5 with English Tran.
Dec. 5, 2017—(US) Notice of Allowance—U.S. Appl. No. 14/437,169.
Jun. 1, 2018—(US) Final Office Action U.S. Appl. No. 14/436,967.

* cited by examiner

| | | | | | | | | | | | | |
|---|---|---|---|---|---|---|---|---|---|---|---|---|
| $R_{i,j}$ | $G_{i,j}$ | $B_{i,j}$ | $R_{i,j+1}$ | $G_{i,j+1}$ | $B_{i,j+1}$ | $R_{i,j+2}$ | $G_{i,j+2}$ | $B_{i,j+2}$ | $R_{i,j+3}$ | $G_{i,j+3}$ | $B_{i,j+3}$ | ... |
| $R_{i+1,j}$ | $G_{i+1,j}$ | $B_{i+1,j}$ | $R_{i+1,j+1}$ | $G_{i+1,j+1}$ | $B_{i+1,j+1}$ | $R_{i+1,j+2}$ | $G_{i+1,j+2}$ | $B_{i+1,j+2}$ | $R_{i+1,j+3}$ | $G_{i+1,j+3}$ | $B_{i+1,j+3}$ | ... |
| $R_{i+2,j}$ | $G_{i+2,j}$ | $B_{i+2,j}$ | $R_{i+2,j+1}$ | $G_{i+2,j+1}$ | $B_{i+2,j+1}$ | $R_{i+2,j+2}$ | $G_{i+2,j+2}$ | $B_{i+2,j+2}$ | $R_{i+2,j+3}$ | $G_{i+2,j+3}$ | $B_{i+2,j+3}$ | ... |
| $R_{i+3,j}$ | $G_{i+3,j}$ | $B_{i+3,j}$ | $R_{i+3,j+1}$ | $G_{i+3,j+1}$ | $B_{i+3,j+1}$ | $R_{i+3,j+2}$ | $G_{i+3,j+2}$ | $B_{i+3,j+2}$ | $R_{i+3,j+3}$ | $G_{i+3,j+3}$ | $B_{i+3,j+3}$ | ... |
| ... | ... | ... | ... | ... | ... | ... | ... | ... | ... | ... | ... | ... |

Figure 5

| | | | | | | |
|---|---|---|---|---|---|---|
| $(R_{i,j}+R_{i+1,j}+R_{i,j+1}+R_{i+1,j+1})/4$ | $(G_{i,j}+G_{i+1,j}+G_{i,j+1}+G_{i+1,j+1})/4$ | $(B_{i,j}+B_{i+1,j}+B_{i,j+1}+B_{i+1,j+1})/4$ | $(R_{i,j+2}+R_{i+1,j+2}+R_{i,j+3}+R_{i+1,j+3})/4$ | $(G_{i,j+2}+G_{i+1,j+2}+G_{i,j+3}+G_{i+1,j+3})/4$ | $(B_{i,j+2}+B_{i+1,j+2}+B_{i,j+3}+B_{i+1,j+3})/4$ | ... |
| $(R_{i+2,j}+R_{i+3,j}+R_{i+2,j+1}+R_{i+3,j+1})/4$ | $(G_{i+2,j}+G_{i+3,j}+G_{i+2,j+1}+G_{i+3,j+1})/4$ | $(B_{i+2,j}+B_{i+3,j}+B_{i+2,j+1}+B_{i+3,j+1})/4$ | $(R_{i+2,j+2}+R_{i+3,j+2}+R_{i+2,j+3}+R_{i+3,j+3})/4$ | $(G_{i+2,j+2}+G_{i+3,j+2}+G_{i+2,j+3}+G_{i+3,j+3})/4$ | $(B_{i+2,j+2}+B_{i+3,j+2}+B_{i+2,j+3}+B_{i+3,j+3})/4$ | ... |
| ... | ... | ... | ... | ... | ... | ... |

Figure 6

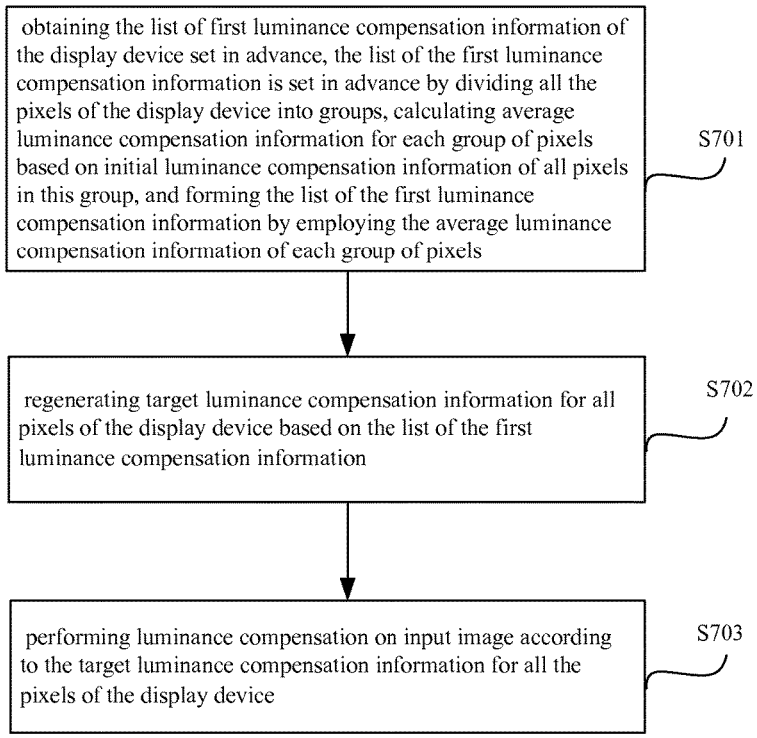

Figure 7

| | | | | | | | | | | | | |
|---|---|---|---|---|---|---|---|---|---|---|---|---|
| $(R_{i,j}+R_{i+1,j}+R_{i-1,j-1}+R_{i+1,j-1})/4$ | $(G_{i,j}+G_{i-1,j}+G_{i-1,j-1}+G_{i+1,j-1})/4$ | $(B_{i,j}+B_{i+1,j}+B_{i+1,j+1}+B_{i+1,j+1})/4$ | $(R_{i,j}+R_{i+1,j}+R_{i+1,j+1}+R_{i+1,j+1})/4$ | $(G_{i,j}+G_{i+1,j}+G_{i+1,j-1}+G_{i+1,j-1})/4$ | $(B_{i,j}+B_{i+1,j}+B_{i+1,j+1}+B_{i+1,j+1})/4$ | $(R_{i,j+2}+R_{i+1,j+2}+R_{i,j+8}+R_{i+1,j+8})/4$ | $(G_{i,j+2}+G_{i+1,j+2}+G_{i,j+8}+G_{i+1,j+8})/4$ | $(B_{i,j+2}+B_{i+1,j+2}+B_{i+1,j+8}+B_{i+1,j+8})/4$ | $(R_{i,j+2}+R_{i+1,j+2}+R_{i-1,j+8}+R_{i-1,j+8})/4$ | $(G_{i,j+2}+G_{i+1,j+2}+G_{i-1,j+8}+G_{i-1,j+8})/4$ | $(B_{i,j+2}+B_{i+1,j+2}+B_{i-1,j+8}+B_{i-1,j+8})/4$ | ... |
| $(R_{i,j}+R_{i+1,j}+R_{i+1,j+1}+R_{i+1,j+1})/4$ | $(G_{i,j}+G_{i+1,j}+G_{i-1,j-1}+G_{i-1,j-1})/4$ | $(B_{i,j}+B_{i+1,j}+B_{i+1,j+1}+B_{i+1,j+1})/4$ | $(R_{i,j}+R_{i+1,j}+R_{i+1,j+1}+R_{i+1,j+1})/4$ | $(G_{i,j}+G_{i+1,j}+G_{i+1,j-1}+G_{i+1,j-1})/4$ | $(B_{i,j}+B_{i+1,j}+B_{i+1,j+1}+B_{i+1,j+1})/4$ | $(R_{i,j+2}+R_{i+1,j+2}+R_{i,j+8}+R_{i+1,j+8})/4$ | $(G_{i,j+2}+G_{i+1,j+2}+G_{i,j+8}+G_{i+1,j+8})/4$ | $(B_{i,j+2}+B_{i+1,j+2}+B_{i+1,j+8}+B_{i+1,j+8})/4$ | $(R_{i,j+2}+R_{i+1,j+2}+R_{i-1,j+8}+R_{i-1,j+8})/4$ | $(G_{i,j+2}+G_{i+1,j+2}+G_{i-1,j+8}+G_{i-1,j+8})/4$ | $(B_{i,j+2}+B_{i+1,j+2}+B_{i-1,j+8}+B_{i-1,j+8})/4$ | ... |
| $(R_{i-2,j}+R_{i-3,j}-R_{i-2,j-1}+R_{i-3,j-1})/4$ | $(G_{i-2,j}+G_{i-3,j}+G_{i-2,j+1}+G_{i-3,j+1})/4$ | $(B_{i-2,j}+B_{i-3,j}+B_{i-2,j+1}+B_{i-3,j+1})/4$ | $(R_{i-2,j}+R_{i-3,j}+R_{i-2,j+1}+R_{i-3,j+1})/4$ | $(G_{i+2,j}+G_{i-2,j-1}+G_{i-3,j-1})/4$ | $(B_{i+2,j}+B_{i-2,j+1}-B_{i+3,j+1})/4$ | $(R_{i+2,j+8}+R_{i-2,j+2}+R_{i-2,j+8}+R_{i-2,j+8})/4$ | $(G_{i+2,j+8}+G_{i-2,j+2}-G_{i-2,j+8}-G_{i-2,j+8})/4$ | $(B_{i+2,j+8}+B_{i-2,j+2}+B_{i-2,j+8}+B_{i-2,j+8})/4$ | $(R_{i+2,j+8}+R_{i-2,j+2}+R_{i-2,j+8}+R_{i-2,j+8})/4$ | $(G_{i+2,j+8}+G_{i+2,j+2}-G_{i+2,j+8}-G_{i+2,j+8})/4$ | $(B_{i+2,j+8}-B_{i+2,j+2}+B_{i+2,j+8}+B_{i+2,j+8})/4$ | ... |
| $(R_{i+2,j}+R_{i+3,j}-R_{i+2,j-1}+R_{i+3,j-1})/4$ | $(G_{i+2,j}+G_{i+3,j}+G_{i+2,j+1}+G_{i+3,j+1})/4$ | $(B_{i+2,j}+B_{i+3,j}+B_{i+2,j+1}+B_{i+3,j+1})/4$ | $(R_{i+2,j}+R_{i+3,j}+R_{i+2,j+1}+R_{i+3,j+1})/4$ | $(G_{i+2,j}+G_{i+2,j-1}+G_{i+3,j-1})/4$ | $(B_{i+2,j}+B_{i+2,j-1}-B_{i+3,j-1})/4$ | $(R_{i+2,j+8}+R_{i+2,j+2}+R_{i+2,j+8}+R_{i+2,j+8})/4$ | $(G_{i+2,j+8}+G_{i+2,j+2}-G_{i+2,j+8}-G_{i+2,j+8})/4$ | $(B_{i+2,j+8}+B_{i+2,j+2}+B_{i+2,j+8}+B_{i+2,j+8})/4$ | $(R_{i+2,j+8}+R_{i+2,j+2}+R_{i+2,j+8}+R_{i+2,j+8})/4$ | $(G_{i+2,j+8}+G_{i+2,j+2}-G_{i+2,j+8}-G_{i+2,j+8})/4$ | $(B_{i+2,j+8}-B_{i+2,j+2}+B_{i+2,j+8}+B_{i+2,j+8})/4$ | ... |
| $(R_{i+2,j}+R_{i+3,j}-R_{i+2,j-1}+R_{i+3,j-1})/4$ | $(G_{i+2,j}+G_{i+3,j}+G_{i+2,j+1}+G_{i+3,j+1})/4$ | $(B_{i+2,j}+B_{i+3,j}+B_{i+2,j+1}+B_{i+3,j+1})/4$ | $(R_{i+2,j}+R_{i+3,j}+R_{i+2,j+1}+R_{i+3,j+1})/4$ | $(G_{i+2,j}+G_{i+2,j-1}+G_{i+3,j-1})/4$ | $(B_{i+2,j}+B_{i+2,j-1}-B_{i+3,j-1})/4$ | $(R_{i+2,j+8}+R_{i+2,j+2}+R_{i+2,j+8}+R_{i+2,j+8})/4$ | $(G_{i+2,j+8}+G_{i+2,j+2}-G_{i+2,j+8}-G_{i+2,j+8})/4$ | $(B_{i+2,j+8}+B_{i+2,j+2}+B_{i+2,j+8}+B_{i+2,j+8})/4$ | $(R_{i+2,j+8}+R_{i+2,j+2}+R_{i+2,j+8}+R_{i+2,j+8})/4$ | $(G_{i+2,j+8}+G_{i+2,j+2}-G_{i+2,j+8}-G_{i+2,j+8})/4$ | $(B_{i+2,j+8}-B_{i+2,j+2}+B_{i+2,j+8}+B_{i+2,j+8})/4$ | ... |
| ... | ... | ... | ... | ... | ... | ... | ... | ... | ... | ... | ... | ... |

Figure 8

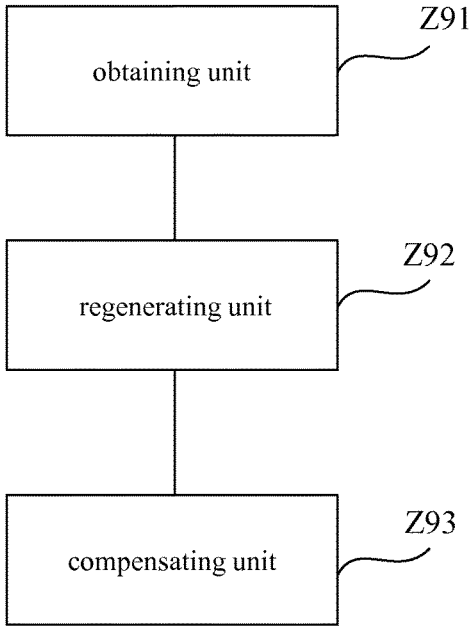

Figure 9

DISPLAY DEVICE AND METHOD AND APPARATUS FOR COMPENSATING LUMINANCE OF DISPLAY DEVICE

The application is a U.S. National Phase Entry of International Application No. PCT/CN2014/087599 filed on Sep. 26, 2014, designating the United States of America and claiming priority to Chinese Patent Application No. 201410240470.5 filed on May 30, 2014. The present application claims priority to and the benefit of the above-identified applications and the above-identified applications are incorporated by reference herein in their entirety.

TECHNICAL FIELD OF THE DISCLOSURE

The present disclosure relates to display device and method and apparatus for compensating luminance of the display device.

BACKGROUND

Under the condition of current production process, Organic Light emitting Diode (OLED) display device has a temporal and spatial non-uniform issue. As the size of the display device is becoming larger, such issue is exposed even more seriously. Therefore, solving the display non-uniform issue in OLED display device of large size becomes one of the indispensable key techniques for mass production. The display non-uniform issue in OLED display device is closely related to the production process. The overall luminance uniformity of the display device goes worse when there is a relative large difference among threshold voltage values of the whole panel; and meanwhile, the organic material used for the display device also faces a problem that the luminance is changed constantly during the lifetime thereof. Therefore, said issues can not be completely solved through only improvement on the process and can only be solved by adopting various compensative driving.

There are two types of compensation methods, i.e., internal compensation and external compensation. The internal compensation method refers to a method of performing compensation by using sub-circuit constructed from Thin Film Transistor (TFT) inside the pixel. The external compensation method refers to a method of drawing the TFT or OLED signal external to backboard and performing compensation by an external Application Specific Integrated Circuit (ASIC). The pixel structure and the driving manner of the internal compensation are usually complicated and the compensation effect is limited to TFT threshold voltage and line voltage drop, and the residual image issue can not be solved. Meanwhile, in the display application of large size, high resolution and high refresh frequency, the internal compensation manner results in a reduced opening ratio and a slow driving speed. The external compensation method has advantages of having a simple pixel structure, a fast driving speed and a good compensation effect, and thus is considered as an optional compensation solution in the display of Active Matrix Organic Light Emitting Diode (AMOLED) of large size.

The external compensation can further be classified into optical drawing compensation and electrical drawing compensation depending on the drawing manner. The optical drawing compensation refers to drawing out a luminance signal through optical Charge Coupled Device (CCD) photographic method after lighting the backboard, and the electrical drawing compensation refers to drawing out electrical signals of TFT and OLED through a sensing circuit of a driving chip. The signals drawn in the two drawing method are of different kinds and data processes performed on them are also different. The optical drawing manner has advantages of having a simple structure and being flexible, and thus is widely used currently.

SUMMARY

Embodiments of the present disclosure provide a luminance compensating method and apparatus for a display device and the display device, which may be used to reduce amount of stored data for the compensation information while improving the luminance uniformity of the display device, so as to reduce the cost of the hardware.

A luminance compensating method for a display device provided by an embodiment of the present disclosure comprises:

obtaining a list of first luminance compensation information of the display device set in advance;

regenerating target luminance compensation information for all pixels of the display device based on the list of the first luminance compensation information; and performing luminance compensation on input image according to the target luminance compensation information for all the pixels of the display device, wherein the list of the first luminance compensation information is set in advance by dividing all the pixels of the display device into groups, calculating average luminance compensation information for each group of pixels based on initial luminance compensation information of all pixels in this group of pixels, and forming the list of the first luminance compensation information by employing the average luminance compensation information of each group of pixels.

It is to be noted that for each of the pixels of the display device, the initial luminance compensation information is predetermined based on a test luminance value and a target luminance value of the pixel under a test pattern. The method for determining the initial luminance compensation information may be one in the prior art and the description is omitted herein.

According to the luminance compensating method for the display device as described above, all the pixels of the display device are divided into groups in advance, the average luminance compensation information for each group of pixels is calculated based on the initial luminance compensation information of all pixels in this group of pixels, and the list of the first luminance compensation information is formed by employing the average luminance compensation information of each group of pixels. Thereby, the list of the first luminance compensation information of the display device set in advance can be obtained when the display device displays normally. Since the data amount of the list of the first luminance compensation information is obviously smaller than the data amount of the initial luminance compensation information of all the pixels, the requirement on the storage space and the transmission bandwidth is reduced, thereby reducing the hardware cost. Furthermore, the above method further regenerates the target luminance compensation information for all pixels of the display device based on the list of the first luminance compensation information so as to perform luminance compensation on the input image according to the target luminance compensation information for all the pixels of the display device, and thus a luminance compensation of high quality may be achieved for each of the pixels.

Optionally, said dividing all the pixels of the display device into groups includes dividing every four adjacent pixels of the display device into one group.

In the existing display devices, the difference of the initial luminance compensation information between adjacent pixels of the display device is not large and thus the above mentioned selection method ensures at a maximum degree that the difference between the initial luminance compensation information of a selected pixel and the initial luminance compensation information of a discarded pixel is relative small, and it also ensures that the selected initial luminance compensation information is distributed uniformly, which benefits the following process of regenerating the target luminance compensation information for all pixels of the display device based on the list of the first luminance compensation information.

Optionally, said regenerating target luminance compensation information for all pixels of the display device based on the list of the first luminance compensation information includes, for each group of pixels, using the average luminance compensation information of this group of pixels as the target luminance compensation information of each pixels in this group.

Optionally, said obtaining the list of first luminance compensation information of the display device set in advance includes obtaining the list of first luminance compensation information of the display device set in advance from a volatile memory.

Since a speed of reading data from the volatile memory is fast, the luminance compensation can be quickly performed on each of the sub-pixels of the input image when the display device displays picture in real time.

Optionally, said obtaining the list of first luminance compensation information of the display device set in advance further includes reading the list of first luminance compensation information of the display device set in advance from a non-volatile memory to the volatile memory before obtaining the list of first luminance compensation information of the display device set in advance from the volatile memory.

Since the volatile memory keeps data for a relative short time, a lifetime of stored data can be ensured by saving the first luminance compensation information into the non-volatile memory. Meanwhile, when the display device operates normally, the list of the first luminance compensation information is read into the volatile memory from the non-volatile memory and the list of the first luminance compensation information is obtained from the volatile memory in real time, thereby efficiency of the real time compensation is guaranteed.

A luminance compensating apparatus for a display device provided by the embodiment of the present disclosure comprises:

an obtaining unit, configured to obtain a list of first luminance compensation information of the display device set in advance;

a regenerating unit, configured to regenerate target luminance compensation information for all pixels of the display device based on the list of the first luminance compensation information; and a compensating unit, configure to perform luminance compensation on input image according to the target luminance compensation information for all the pixels of the display device, wherein the list of the first luminance compensation information obtained by the obtaining unit is set in advance by dividing all the pixels of the display device into groups, calculating average luminance compensation information for each group of pixels based on initial luminance compensation information of all pixels in this group of pixels, and forming the list of the first luminance compensation information by employing the average luminance compensation information of each group of pixels.

It is to be noted that for each of the pixels of the display device, the initial luminance compensation information is predetermined based on a test luminance value and a target luminance value of the pixel under a test pattern. The method for determining the initial luminance compensation information may be one in the prior art and the description is omitted herein.

According to the luminance compensating apparatus for the display device as described above, all the pixels of the display device are divided into groups in advance, the average luminance compensation information for each group of pixels is calculated based on the initial luminance compensation information of all pixels in this group of pixels, and the list of the first luminance compensation information is formed by employing the average luminance compensation information of each group of pixels. Thereby, the list of the first luminance compensation information of the display device set in advance can be obtained when the display device displays normally. Since the data amount of the list of the first luminance compensation information is obviously smaller than the data amount of the initial luminance compensation information of all the pixels, the requirement on the storage space and the transmission bandwidth is reduced, thereby reducing the hardware cost. Furthermore, the above apparatus further regenerates the target luminance compensation information for all pixels of the display device based on the list of the first luminance compensation information so as to perform luminance compensation on the input image according to the target luminance compensation information for all the pixels of the display device, and thus a luminance compensation of high quality may be achieved for each of the pixels.

Optionally, the apparatus further includes: a presetting unit, configured to divide every four adjacent pixels of the display device into one group, calculate the average luminance compensation information for each group of pixels based on initial luminance compensation information of all pixels in this group, and form the list of the first luminance compensation information by employing the average luminance compensation information for each group of pixels.

In the existing display devices, the difference of the initial luminance compensation information between adjacent pixels of the display device is not large and thus the above mentioned selection method ensures at a maximum degree that the difference between the initial luminance compensation information of a selected pixel and the initial luminance compensation information of a discarded pixel is relative small, and it also ensures that the selected initial luminance compensation information is distributed uniformly, which benefits the following process of regenerating the target luminance compensation information for all pixels of the display device based on the list of the first luminance compensation information.

Optionally, the regenerating unit is particularly configured to, for each group of pixels, use the average luminance compensation information of this group of pixels as the target luminance compensation information of each of pixels in this group.

Optionally, the obtaining unit is particularly configured to obtain the list of the first luminance compensation information from a volatile memory of the display device.

Since a speed of reading data from the volatile memory is fast, the luminance compensation can be quickly performed on each of the sub-pixels of the input image when the display device displays picture in real time.

Optionally, the obtaining unit is further particularly configured to read the list of first luminance compensation information of the display device set in advance from a non-volatile memory to the volatile memory before obtaining the list of first luminance compensation information of the display device set in advance from the volatile memory.

Since the volatile memory keeps data for a relative short time, a lifetime of stored data can be ensured by saving the first luminance compensation information into the non-volatile memory. Meanwhile, when the display device operates normally, the list of the first luminance compensation information is read into the volatile memory from the non-volatile memory and the list of the first luminance compensation information is obtained from the volatile memory in real time, thereby efficiency of the real time compensation is guaranteed.

A display device is also provided in an embodiment of the present disclosure, and the display device includes the luminance compensating apparatus as described above.

BRIEF DESCRIPTION OF THE DRAWINGS

FIG. 5 is a schematic diagram illustrating an arrangement of initial luminance compensation information of the pixel array in the display device;

FIG. 6 is a schematic diagram illustrating constitution of the list of the first luminance compensation information provided by the embodiment of the present disclosure;

FIG. 7 is a schematic flow chart showing a method for compensating the luminance of the display device provided by an embodiment of the present disclosure;

FIG. 8 is a schematic diagram of a list of target luminance compensation information regenerated for all the pixels provided by an embodiment of the present disclosure;

FIG. 9 is a schematic structure diagram of an apparatus for compensating the luminance of the display device provided by an embodiment of the present disclosure.

DETAILED DESCRIPTION

Figure 1:
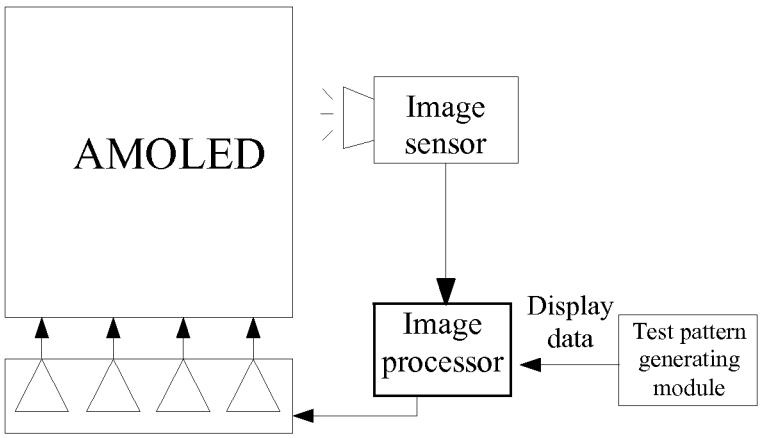
FIG. 1 is a schematic diagram illustrating principles of an external optical compensation.
Figure 2:
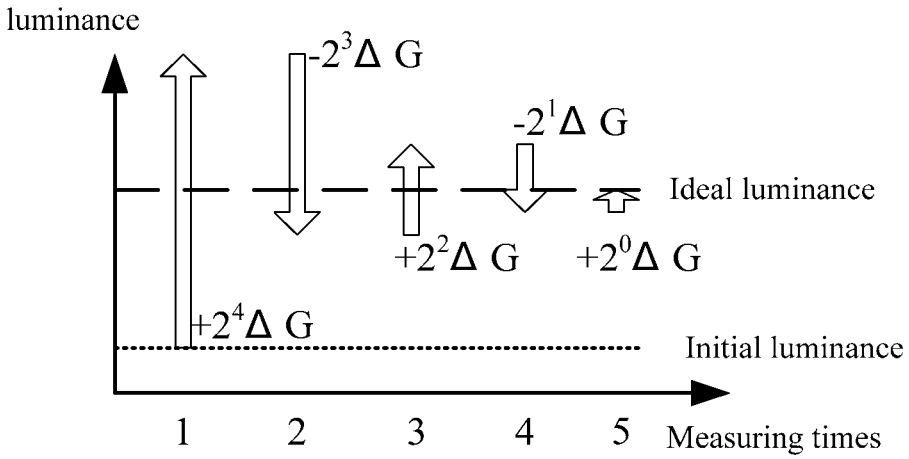
FIG. 2 is a schematic diagram illustrating a calculation method for the external optical compensation.

FIG. 1 a schematic method diagram of an external optical compensation solution. Optical sensing devices are usually CCD camera. This method is performed by comparing a luminance value obtained from photographing with an ideal value, and selecting an appropriate gray level shift $\Delta G$ and adopting a gradual approximation manner, as shown in FIG. 2. The compensation precision of this method depends on $\Delta G$ and a compensation range is $(2^n-1)\ \Delta G$, wherein n is measuring times. Such compensation information can be obtained for each of the pixels in the display device, and all the compensation information is stored in a memory of the display device. The compensation information is read out from the memory and the luminance compensation is performed on the display device, when the display device performs a normal display. When the data amount of the compensation information to be stored in the memory is relative large, however, storage space of the memory and bandwidth for transmitting the compensation information will become limitation conditions, and production cost will be increased if the storage space of the memory or the bandwidth for transmitting the compensation information is increased.

Therefore, it is an issue to be solved how to implement a luminance compensation of high quality while reducing the hardware cost in a procedure of performing luminance compensation on the display device in order to improve the luminance uniformity of the display device.

Embodiments of the present disclosure provide a luminance compensating method and apparatus for a display device and the display device, which may be used to reduce amount of stored data for the compensation information while improving the luminance uniformity of the display device, so as to reduce the cost of the hardware.

A clear and complete description of the technical solutions of the embodiments of the present disclosure will be described with reference to the drawings in the embodiments. Obviously, the embodiments described herein are only part of, but not all of, the embodiments of the present disclosure. Based on the embodiments of the present disclosure, all other embodiments obtained by those ordinary skilled in the art without creative effort belong to the protection scope of the present disclosure.

Figure 3:
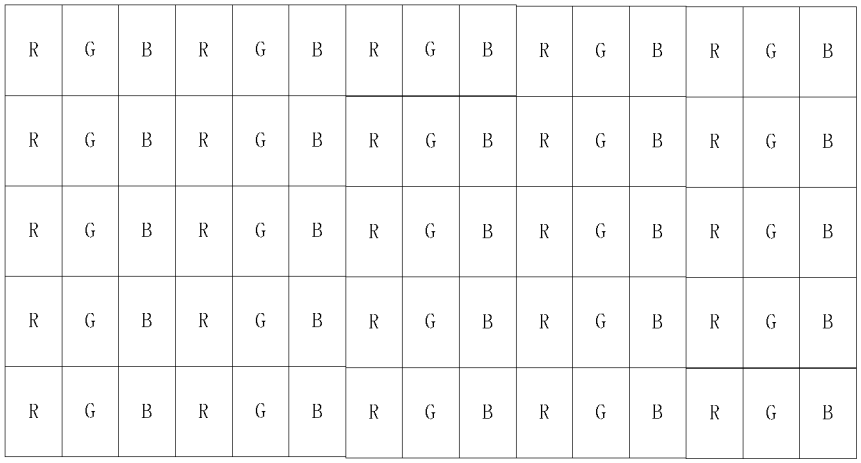
FIG. 3 is a schematic diagram illustrating a sub-pixel arrangement in the display device.

Firstly, pixel constitution of the display device is described. Generally, a display device is a display device with i rows and j columns, and thus it can be considered as a lattice consisted of i×j pixels. It is assumed that each of the pixels includes three sub-pixels: a red sub-pixel R, a green sub-pixel G and a blue sub-pixel B, and thus the display device can be considered as a lattice of i×j×3 sub-pixels. For example, as shown in FIG. 3, as for a display device with 5 rows and 5 columns, the display device can be considered as a lattice of 5×15 sub-pixels. When performing luminance compensation on an input image of the display device, the luminance compensation is performed in units of a sub-pixel of the display device.

The luminance compensating method for a display device provided by the present disclosure is described below.

The luminance compensating method provided by an embodiment of the present disclosure comprises:

obtaining a list of first luminance compensation information of the display device set in advance;

regenerating target luminance compensation information for all pixels of the display device based on the list of the first luminance compensation information; and performing luminance compensation on input image according to the target luminance compensation information for all the pixels of the display device, wherein the list of the first luminance compensation information is set in advance by dividing all the pixels of the display device into groups, calculating average luminance compensation information for each group of pixels based on initial luminance compensation information of all pixels in this group of pixels, and forming the list of the first luminance compensation information by employing the average luminance compensation information of each group of pixels.

It is to be noted that for each of the pixels of the display device, the initial luminance compensation information is predetermined based on a test luminance value and a target luminance value of the pixel under a test pattern. The method for determining the initial luminance compensation information for each of the pixels may be one in the prior art and the initial luminance compensation information may be a gray level compensation quantity or a compensation coefficient, which will not be limited herein. The process of determining the initial luminance compensation information for each of the pixels is omitted in the embodiment of the present disclosure.

According to the luminance compensating method for the display device as described above, all the pixels of the display device are divided into groups in advance, the average luminance compensation information for each group of pixels is calculated based on the initial luminance compensation information of all pixels in this group of pixels, and the list of the first luminance compensation information is formed by employing the average luminance compensation information of each group of pixels. Thereby, the list of the first luminance compensation information of the display device set in advance can be obtained when the display device displays normally. Since the data amount of the list of the first luminance compensation information is obviously smaller than the data amount of the initial luminance compensation information of all the pixels, the requirement on the storage space and the transmission bandwidth is reduced, thereby reducing the hardware cost. Furthermore, the above method further regenerates the target luminance compensation information for all pixels of the display device based on the list of the first luminance compensation information so as to perform luminance compensation on the input image according to the target luminance compensation information for all the pixels of the display device, and thus a luminance compensation of high quality may be achieved for each of the pixels.

Optionally, said dividing all the pixels of the display device into groups includes dividing every four adjacent pixels of the display device into one group.

In the existing display devices, the difference of the initial luminance compensation information between adjacent pixels of the display device is not large and thus the above mentioned selection method ensures at a maximum degree that the difference between the initial luminance compensation information of a selected pixel and the initial luminance compensation information of a discarded pixel is relative small, and it also ensures that the selected initial luminance compensation information is distributed uniformly, which benefits the following process of regenerating the target luminance compensation information for all pixels of the display device based on the list of the first luminance compensation information. The four adjacent pixels which are divided into one group may be, for example, a pixel in the first row and the first column, a pixel in the first row and the second column, a pixel in the second row and the first column and a pixel in the second row and the second column. That is to say, a pixel adjacent to one pixel in the right side, a pixel adjacent to the one pixel in the lower side, and a pixel adjacent to the one pixel in the lower-right side in the pixel array are selected. Of course, the grouping manner is not limited to that as described above, and for example, four adjacent pixels in a same row or four adjacent pixels in a same column may also be divided into one group.

On the other hand, it is not necessary to divide four adjacent pixels into one group, other suitable numbers of adjacent pixels may be divided into one group. For example, two adjacent pixels, nine adjacent pixels or the like can be divided into one group.

Optionally, said regenerating target luminance compensation information for all pixels of the display device based on the list of the first luminance compensation information includes, for each group of pixels, using the average luminance compensation information of this group of pixels as the target luminance compensation information of each pixels in this group.

Of course, the method for regenerating target luminance compensation information for all pixels of the display device based on the list of the first luminance compensation information is not limited to that as described above, and any other appropriate methods may be employed as long as it may ensure that, for each of the pixels, a difference between the regenerated target luminance compensation information and the initial luminance compensation information of this pixel is relative small, and the smaller, the better.

Optionally, said obtaining the list of first luminance compensation information of the display device set in advance includes obtaining the list of first luminance compensation information of the display device set in advance from a volatile memory.

Since a speed of reading data from the volatile memory is fast, the luminance compensation can be quickly performed on each of the sub-pixels of the input image when the display device displays picture in real time.

Optionally, said obtaining the list of first luminance compensation information of the display device set in advance further includes reading the list of first luminance compensation information of the display device set in advance from a non-volatile memory to the volatile memory before obtaining the list of first luminance compensation information of the display device set in advance from the volatile memory.

Since the volatile memory keeps data for a relative short time, a lifetime of stored data can be ensured by saving the first luminance compensation information into the non-volatile memory. Meanwhile, when the display device operates normally, the list of the first luminance compensation information is read into the volatile memory from the non-volatile memory and the list of the first luminance compensation information is obtained from the volatile memory in real time, thereby efficiency of the real time compensation is guaranteed.

The luminance compensating method for the display device provided by the present disclosure is described below in detail with reference to drawings and specific embodiments.

The luminance compensating method for the display device provided by the embodiment of the present disclosure sets a list of first luminance compensation information in advance, and the process of setting the list of the first luminance compensation information is completed before shipment of the display device product. First, the process of setting the list of the first luminance compensation information in advance is described as below.

Figure 4:
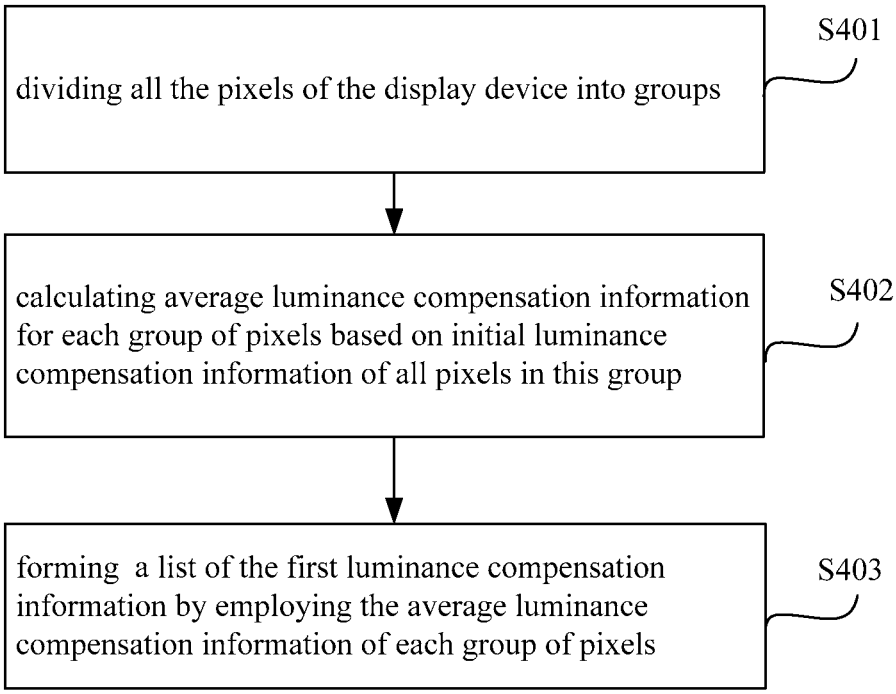
FIG. 4 is a schematic flow chart illustrating a method for setting a list of first luminance compensation information in advance among luminance compensation methods provided by an embodiment of the present disclosure.

As shown in FIG. 4, the process of setting the list of the first luminance compensation information in advance includes:

step S401 of dividing all the pixels of the display device into groups;

step S402 of calculating average luminance compensation information for each group of pixels based on initial luminance compensation information of all pixels in this group of pixels; and step S403 of forming the list of the first luminance compensation information by employing the average luminance compensation information of each group of pixels.

Wherein, in step S401, every four adjacent pixels in the display device are divided into one group. As shown in FIG. 5, a pixel in the ith row and the jth column, a pixel in the (i+1)th row and the jth column, a pixel in the ith row and the (j+1)th column, and a pixel in the (i+1)th row and the (j+1)th column can form a group. In specific, a first group may consists of a pixel in the first row and the first column, a pixel in the first row and the second column, a pixel in the second row and the first column, and a pixel in the second row and the second column. That is to say, the pixel in the first row and the first column in the pixel array is selected, and this pixel and a pixel adjacent to this pixel in the right side, a pixel adjacent to the this pixel in the lower side and a pixel adjacent to the this pixel in the lower-right side are grouped together, and all the other pixels are grouped in this way.

In step S402, the average luminance compensation information for each group of pixels is calculated based on the initial luminance compensation information of all pixels in this group of pixels. For example, if the initial luminance compensation information of each of pixels is a grey level quantity, an average compensation quantity is obtained by averaging the grey level compensation quantities of each pixel in this group. For example, as for a group of pixels that the pixel of the ith row and the jth column belongs to, it is obtained that an average luminance compensation information for the red sub-pixels R in this group of pixels is $(R_{i,j}+R_{i+1,j}+R_{i,j+1}+R_{i+1,j+1})/4$; an average luminance compensation information for the green sub-pixels G in this group of pixels is $(G_{i,j}+G_{i+1,j}+G_{i,j+1}+G_{i+1,j+1})/4$; and an average luminance compensation information for the blue sub-pixels B in this group of pixels is $(B_{i,j}+B_{i+1,j}+B_{i,j+1}+B_{i+1,j+1})/4$.

In step S403, the list of the first luminance compensation information is formed by employing the average luminance compensation information of each group of pixels. For example, the list of the first luminance compensation information is as shown in FIG. 6.

After setting the list of the first luminance compensation information in advance, the list of the first luminance compensation information is stored in the memory of the display device. Optionally, since a lifetime of data being kept in the non-volatile memory is long and a speed of reading data from volatile memory is fast, the list of the first luminance compensation information is saved in the non-volatile memory of the display device when saving the list of the first luminance compensation information in the memory of the display device.

For a display with i rows and j columns, if the initial luminance compensation information of all pixels is stored, the amount of the data composed of these compensation information is i*j*3*n bits, wherein n represents a bit width of the initial luminance compensation information of each sub-pixel. For example, taking a resolution of 3840*2160 as an example, the amount of the data composed of these compensation information is 3840*2160*3*n bits, which determines the capacity of the volatile memory and the non-volatile memory. It is assumed that the bit width of the initial luminance compensation information of each sub-pixel is 16 bits, then the data amount of these compensation information is almost 400M bits, which means both of the volatile memory and the non-volatile memory should have a capacity of more than 400M bits, so as to meet the requirement. Meanwhile, the requirement for the data bandwidth of the control section is also high when performing real time compensation. As a consumer electronic product, the display device is sensitive to the cost price, therefore, in order to reduce the hardware cost, reducing the data amount of the compensation information is critical for mass production. Also taking the resolution of 3840*2160 as an example, with the luminance compensating method for the display device provided in the present disclosure, the data amount of the list of the first luminance compensation information is only 3840*2160*3*n/4 bits, which greatly decreases the capacity requirement for the volatile memory and the non-volatile memory and the requirement for the transmission bandwidth, thereby reducing the hardware cost in the production.

When the display device operates normally, first, the list of the first luminance compensation information is read into the volatile memory from the non-volatile memory, and then the list of the first luminance compensation information is obtained from the volatile memory in real time, thereby the luminance compensation can be performed in real time and finally the luminance uniformity of the display device can be improved. In specific, as shown in FIG. 7, when the display device operates normally, the method for performing luminance compensation on the display device includes the following steps.

Step S701: the list of first luminance compensation information of the display device set in advance is obtained. Wherein the list of the first luminance compensation information is set in advance by dividing all the pixels of the display device into groups, calculating average luminance compensation information for each group of pixels based on initial luminance compensation information of all pixels in this group of pixels, and forming the list of the first luminance compensation information by employing the average luminance compensation information of each group of pixels, and wherein for each of the pixels of the display device, the initial luminance compensation information is predetermined based on a test luminance value and a target luminance value of this pixel under a test pattern.

Step S702: target luminance compensation information for all pixels of the display device is regenerated based on the list of the first luminance compensation information.

Step S703: luminance compensation is performed on input image according to the target luminance compensation information for all the pixels of the display device.

In specific, in step S701, the list of the first luminance compensation information of the display device set in advance is read into the volatile memory from the non-volatile memory, and the list of the first luminance compensation information is obtained from the volatile memory in real time.

In step S702, for example, the following manner can be employed: for each group of pixels, the average luminance compensation information of this group of pixels is used as the target luminance compensation information of each pixel of this group of pixels.

Herein, taking the grouping manner exemplified in step S401 as an example, for each group of pixels, the average luminance compensation information of this group of pixels is used as the target luminance compensation information of each pixel in this group of pixels. For example, for a pixel group consisted of the pixel in the first row and the first column, the pixel in the first row and the second column, the pixel in the second row and the first column and the pixel in the second row and the second column, taking the red sub-pixels as an example, an average luminance compensation information of the red sub-pixels R in this group of pixels is $(R_{1,1}+R_{2,1}+R_{1,2}+R_{2,2})/4$, and this average luminance compensation information is used as the target luminance compensation information of the sub-pixel R of the pixel in the first row and the first column, the target luminance compensation information of the sub-pixel R of the pixel in the first row and the second column, the target luminance compensation information of the sub-pixel R of the pixel in the second row and the first column, and the target luminance compensation information of the sub-pixel R of the pixel in the second row and the second column.

That is to say, for a pixel group consisted of the pixel in the ith row and the jth column, the pixel in the (i+1)th row and the jth column, the pixel in the ith row and the (j+1)th column, and the pixel in the (i+1)th row and the (j+1)th column, an average luminance compensation information of the red sub-pixels R is $(R_{i,j}+R_{i+1,j}+R_{i,j+1}+R_{i+1,j+1})/4$, and this average luminance compensation information is used as the target luminance compensation information of the sub-pixel R of the pixel in the ith row and the jth column, the target luminance compensation information of the sub-pixel R of the pixel in the (i+1)th row and the jth column, the target luminance compensation information of the sub-pixel R of the pixel in the ith row and the (j+1)th column, and the target luminance compensation information of the sub-pixel R of the pixel in the (i+1)th row and the (j+1)th column. The target luminance compensation information of the green sub-pixels G and the blue sub-pixels B of the respective pixels in this group is determined similarly. For example, FIG. 8 illustrates a schematic diagram of the list of the target luminance compensation information of all the pixels determined in this manner.

In step S703, the luminance compensation is performed on the input image according to the target luminance compensation information of all the pixels of the display device. This step can employ techniques in the prior art and the detailed process is not described.

The luminance compensation method for the display device provided by the present disclosure has been described above in detail, and the luminance compensation apparatus for the display device provided by an embodiment of the present disclosure will be described below with reference to the figures.

As shown in FIG. 9, the luminance compensation apparatus for the display device provided by an embodiment of the present disclosure includes: an obtaining unit Z91, configured to obtain a list of first luminance compensation information of the display device set in advance; a regenerating unit Z92, configured to regenerate target luminance compensation information for all pixels of the display device based on the list of the first luminance compensation information; and a compensating unit Z93, configure to perform luminance compensation on input image according to the target luminance compensation information for all the pixels of the display device.

Wherein the list of the first luminance compensation information obtained by the obtaining unit is set in advance by dividing all the pixels of the display device into groups, calculating average luminance compensation information for each group of pixels based on initial luminance compensation information of all pixels in this group of pixels, and forming the list of the first luminance compensation information by employing the average luminance compensation information of each group of pixels.

Wherein, for each of the pixels of the display device, the initial luminance compensation information is predetermined based on a test luminance value and a target luminance value of the pixel under a test pattern.

In a preferable embodiment, the luminance compensation apparatus provided by the embodiment of the present disclosure can be a control module of the display device, and the obtaining unit, the regenerating unit and the compensating unit can be realized by a specific processor.

According to the luminance compensating apparatus for the display device as described above, all the pixels of the display device are divided into groups in advance, the average luminance compensation information for each group of pixels is calculated based on the initial luminance compensation information of all pixels in this group of pixels, and the list of the first luminance compensation information is formed by employing the average luminance compensation information of each group of pixels. Thereby, the list of the first luminance compensation information of the display device set in advance can be obtained when the display device displays normally. Since the data amount of the list of the first luminance compensation information is obviously smaller than the data amount of the initial luminance compensation information of all the pixels, the requirement on the storage space and the transmission bandwidth is reduced, thereby reducing the hardware cost. Furthermore, the above apparatus further regenerates the target luminance compensation information for all pixels of the display device based on the list of the first luminance compensation information so as to perform luminance compensation on the input image according to the target luminance compensation information for all the pixels of the display device, and thus a luminance compensation of high quality may be achieved for each of the pixels.

Optionally, the apparatus further includes: a presetting unit, configured to divide every four adjacent pixels of the display device into one group, calculate the average luminance compensation information for each group of pixels based on initial luminance compensation information of all pixels in this group, and form the list of the first luminance compensation information by employing the average luminance compensation information for each group of pixels.

In the existing display devices, the difference of the initial luminance compensation information between adjacent pixels of the display device is not large and thus the above mentioned selection method ensures at a maximum degree that the difference between the initial luminance compensation information of a selected pixel and the initial luminance compensation information of a discarded pixel is relative small, and it also ensures that the selected initial luminance compensation information is distributed uniformly, which benefits the following process of regenerating the target luminance compensation information for all pixels of the display device based on the list of the first luminance compensation information.

It is to be noted that the presetting unit can be disposed inside the display device or be independent of the display device. In a preferable embodiment, the presetting unit is a data processor independent of the display device.

Optionally, the regenerating unit is particularly configured to, for each group of pixels, use the average luminance compensation information of this group of pixels as the target luminance compensation information of each of pixels in this group.

Optionally, the obtaining unit is particularly configured to obtain the list of the first luminance compensation information from a volatile memory of the display device.

Since a speed of reading data from the volatile memory is fast, the luminance compensation can be quickly performed on each of the sub-pixels of the input image when the display device displays picture in real time.

Optionally, the obtaining unit is further particularly configured to read the list of first luminance compensation information of the display device set in advance from a non-volatile memory to the volatile memory before obtaining the list of first luminance compensation information of the display device set in advance from the volatile memory.

Since the volatile memory keeps data for a relative short time, a lifetime of stored data can be ensured by saving the first luminance compensation information into the non-volatile memory. Meanwhile, when the display device operates normally, the list of the first luminance compensation information is read into the volatile memory from the non-volatile memory and the list of the first luminance compensation information is obtained from the volatile memory in real time, thereby efficiency of the real time compensation is guaranteed.

A display device is also provided in an embodiment of the present disclosure, and the display device includes the luminance compensating apparatus as described above. The display device can be any product or section having a display function, such as liquid crystal panel, electronic paper, OLED panel, mobile phone, tablet, TV set, display, notebook computer, digital photo frame, navigation, or the like.

The luminance compensating apparatus provided by the embodiment of the present disclosure is described below with reference to the figures and specific embodiments.

The following description is given in an example where the presetting unit is independent of the display device and the luminance compensating apparatus is a control module of the display device.

Figure 10:
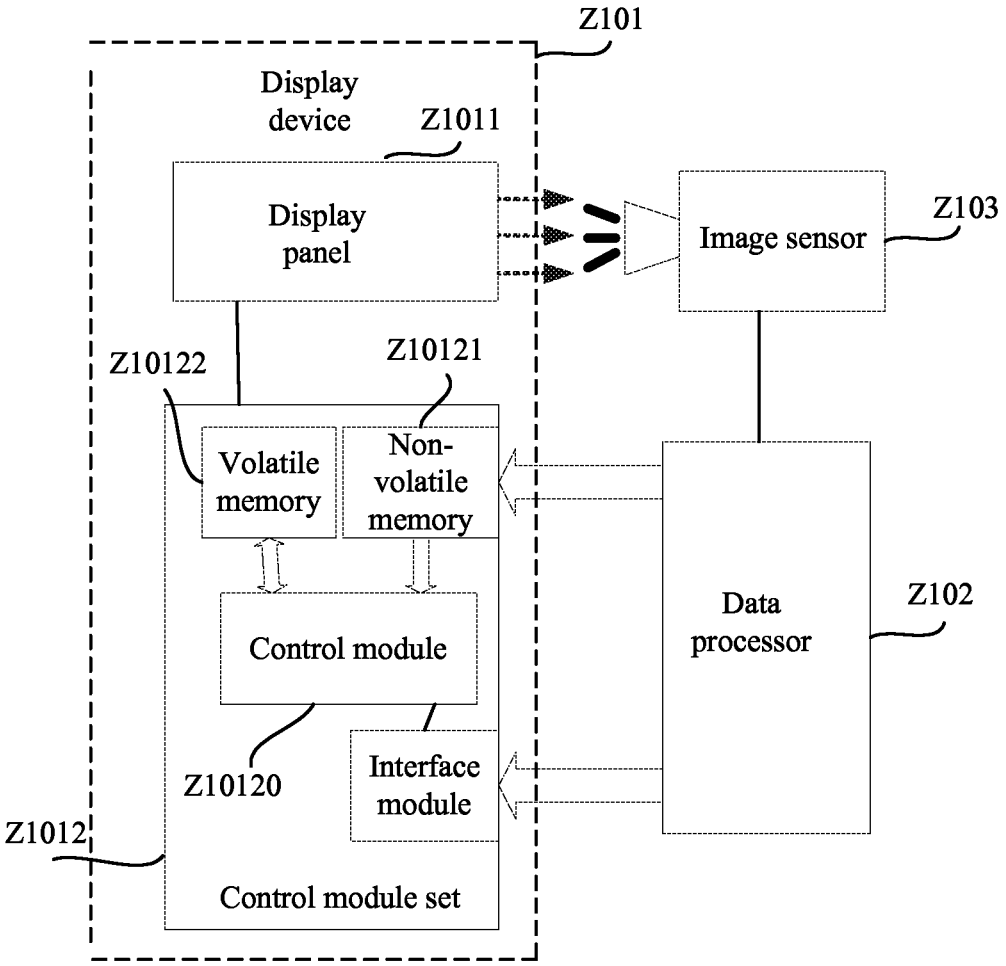
FIG. 10 is a schematic diagram showing connection relationships of the respective apparatus when compensating the luminance of the display device provided by the embodiment of the present disclosure.

As shown in FIG. 10, when performing luminance compensation on a display device Z101, a test pattern is required to be generated by a data processor Z102, and a testing luminance value of the pixel under the test pattern is collected by an image sensor Z103.

The display device Z101 includes a display panel Z1011 and a control module set Z1012 for controlling display of the display panel.

Furthermore, the control module set Z1012 includes a control module Z10120, a non-volatile memory Z10121, a volatile memory Z10122, and an interface module.

Wherein, the control module Z10120 includes:

an obtaining unit configured to obtain a list of first luminance compensation information of the display device set in advance, in specific, the obtaining unit reading the list of the first luminance compensation information into the volatile memory from the non-volatile memory and further obtaining the list of the first luminance compensation information from the volatile memory;

a regenerating unit configured to regenerate target luminance compensation information for all pixels of the display device based on the list of the first luminance compensation information; in specific, for each group of pixels, the average luminance compensation information of this group of pixels being used as the target luminance compensation information of the pixels of this group; and a compensating unit configured to perform luminance compensation on input image according to the target luminance compensation information of all the pixels of the display device.

Both of the non-volatile memory Z10121 and the volatile memory Z10122 are used for storing the list of the first luminance compensation information. The non-volatile memory Z10121 is used for storing the list of the first luminance compensation information sent by the data processor Z102, and the volatile memory Z10122 is used for storing the list of the first luminance compensation information read from the non-volatile memory Z10121 by the control module.

The interface module is used for receiving the input test pattern during a testing phase, and for receiving the input image when the display device operates normally. This module can employ techniques in the prior art and thus the description thereof is omitted.

The display panel can be AMOLED or liquid crystal panel and is not limited herein.

The data processor Z102 is used for presetting the list of the first luminance compensation information. In specific, in a pixel array of the display device, every four adjacent pixels of the display device are divided into one group, the average luminance compensation information of each group of pixels is calculated based on initial luminance compensation information of all pixels in this group, and the list of the first luminance compensation information is formed using the average luminance compensation information of each group of pixels.

In summary, the method and apparatus for compensating the luminance of the display device and the device provided by the embodiments of the present disclosure divide all the pixels of this display device into groups in advance, calculate the average luminance compensation information for each group of pixels based on the initial luminance compensation information of all pixels in this group of pixels, and form the list of the first luminance compensation information by employing the average luminance compensation information for each group of pixels. Thereby, the list of the first luminance compensation information of the display device set in advance can be obtained when the display device displays normally. Since the data amount of the list of the first luminance compensation information is obviously smaller than the data amount of the initial luminance compensation information of all the pixels, the requirement on the storage space and the transmission bandwidth is reduced, thereby reducing the hardware cost. Furthermore, the above apparatus further regenerates the target luminance compensation information for all pixels of the display device based on the list of the first luminance compensation information so as to perform luminance compensation on the input image according to the target luminance compensation information for all the pixels of the display device, and thus a luminance compensation of high quality may be achieved for each of the pixels.

The present disclosure is described by referring to the flowcharts and/or block diagrams of the method, devices (systems) and computer program products according to the embodiments of the present disclosure. It should be understood that every process and/or block in the flowcharts and/or block diagrams and a combination of the processes and/or blocks in the flowcharts and/or block diagrams can be realized by computer program instructions. These computer program instructions may be provided to a general purpose computer, a special purpose computer, a embedded processor or a processor of other programmable data processing devices to produce a machine, such that the instructions executed by a computer or a processor of other programmable data processing devices generate means for realizing the functions specified in one process or multiple processes of the flowcharts and/or in one block or multiple blocks of the block diagrams.

These computer program instructions may also be stored in a computer-readable memory which can instruct a computer or other programmable data processing devices to operate in a particular way, such that the instructions stored in the computer-readable memory generate manufacture products including instruction means which realize the functions specified in one process or multiple processes of the flowcharts and/or in one block or multiple blocks of the block diagrams.

These computer program instructions may also be loaded onto a computer or other programmable data processing devices, such that a series of steps are implemented on the computer or other programmable devices to generate a computer implemented process, thereby the instructions executed on a computer or other programmable devices provide steps for realizing the functions specified in one process or multiple processes of the flowcharts and/or in one block or multiple blocks of the block diagrams.

Obviously, those skilled in the art may make various modifications and variations to the present disclosure without departing from the spirit and scope of the present disclosure. As such, if such modifications and variations of the present disclosure belong to the technical scope of the claims of the present disclosure and their equivalents, these modifications and variations are also intended to be incorporated within the protection scope of the present disclosure.

The present application claims the priority of Chinese Patent Application No. 201410240470.5 filed on May 30, 2014, entire content of which is incorporated as part of the present invention by reference.

What is claimed is:

1. A luminance compensating method for a display device, comprising:

obtaining a list of first luminance compensation information of the display device set in advance;

regenerating target luminance compensation information for all pixels of the display device based on the list of the first luminance compensation information; and performing luminance compensation on an input image according to the target luminance compensation information for all the pixels of the display device, wherein the list of the first luminance compensation information is set in advance by dividing all the pixels of the display device into groups, calculating average value of initial luminance compensation information of all pixels in the group of pixels as an average luminance compensation information of the group of pixels, and forming the list of the first luminance compensation information by employing the average luminance compensation information of each group of pixels, wherein the initial luminance compensation information of each of the pixels of the display device is a gray level compensation quantity or a compensation coefficient predetermined based on a test luminance value and a target luminance value of the pixel under a test pattern, and wherein said regenerating target luminance compensation information for all pixels of the display device based on the list of the first luminance compensation information comprises:

for each group of pixels, using same target luminance compensation information for respective pixel in the group, wherein the same target luminance compensation information is the average luminance compensation information of the group of pixels.

2. The method according to claim 1, wherein said dividing all the pixels of the display device into groups comprises:

dividing every four adjacent pixels of the display device into one group.

3. The method according to claim 1, wherein said calculating average luminance compensation information for each group of pixels based on initial luminance compensation information of all pixels in the group of pixels comprises:

calculating average luminance compensation information of red sub-pixels, average luminance compensation information of green sub-pixels, and average luminance compensation information of blue sub-pixels for each group of pixels based on the initial luminance compensation information of the red sub-pixels, the initial luminance compensation information of the green sub-pixels and the initial luminance compensation information of the blue sub-pixels of all the pixels in the group, respectively.

4. The method according to claim 3, wherein said regenerating target luminance compensation information for all pixels of the display device based on the list of the first luminance compensation information comprises:

for each group of pixels, using the average luminance compensation information of the red sub-pixels of the group of pixels as the target luminance compensation information of the red sub-pixel of each of the pixels in the group, using the average luminance compensation information of the green sub-pixels of the group of pixels as the target luminance compensation information of the green sub-pixel of each of the pixels in the group, and using the average luminance compensation information of the blue sub-pixels of the group of pixels as the target luminance compensation information of the blue sub-pixel of each of the pixels in the group.

5. The method according to claim 1, wherein said obtaining the list of first luminance compensation information comprises:

obtaining the list of first luminance compensation information from a volatile memory of the display device.

6. The method according to claim 5, wherein said obtaining the list of first luminance compensation information further comprises:

reading the list of first luminance compensation information from a non-volatile memory of the display device to the volatile memory before obtaining the list of first luminance compensation information from the volatile memory of the display device.

7. A luminance compensating apparatus for a display device, comprising:

one or more processors; and a memory for storing computer program instructions, the computer program instructions, when being executed by at least one of the processors, perform the processes of:

obtaining a list of first luminance compensation information of the display device set in advance;

regenerating target luminance compensation information for all pixels of the display device based on the list of the first luminance compensation information; and performing luminance compensation on an input image according to the target luminance compensation information for all the pixels of the display device, wherein the list of the first luminance compensation information is set in advance by dividing all the pixels of the display device into groups, calculating average value of initial luminance compensation information of all pixels in the group of pixels as an average luminance compensation information of the group of pixels, and forming the list of the first luminance compensation information by employing the average luminance compensation information of each group of pixels, wherein the initial luminance compensation information of each of the pixels of the display device is a gray level compensation quantity or a compensation coefficient predetermined based on a test luminance value and a target luminance value of the pixel under a test pattern, and wherein said regenerating target luminance compensation information further includes using, for each group of pixels, same target luminance compensation information for respective pixel in the group, wherein the same target luminance compensation information is the average luminance compensation information of the group of pixels.

8. The apparatus according to claim 7, wherein the computer program instructions, when being executed by at least one of the processors, further perform the processes of:

dividing every four adjacent pixels of the display device into one group, calculating the average luminance compensation information for each group of pixels based on initial luminance compensation information of all pixels in the group, and forming the list of the first luminance compensation information by employing the average luminance compensation information of each group of pixels.

9. The apparatus according to claim 7, wherein said calculating the average luminance compensation information for each group of pixels based on initial luminance compensation information of all pixels in the group further includes:

calculating average luminance compensation information of red sub-pixels, average luminance compensation information of green sub-pixels, and average luminance compensation information of blue sub-pixels for each group of pixels based on the initial luminance compensation information of the red sub-pixels, the initial luminance compensation information of the green sub-pixels and the initial luminance compensation information of the blue sub-pixels of all the pixels in the group, respectively.

10. The apparatus according to claim 9, wherein said regenerating target luminance compensation information further includes:

for each group of pixels, using average luminance compensation information of the red sub-pixels of the group of pixels as the target luminance compensation information of the red sub-pixel of each of the pixels in the group, using the average luminance compensation information of the green sub-pixels of the group of pixels as the target luminance compensation information of the green sub-pixel of each of the pixels in the group, and using the average luminance compensation information of the blue sub-pixels of the group of pixels as the target luminance compensation information of the blue sub-pixel of each of the pixels in the group.

11. The apparatus according to claim 7, wherein said obtaining a list of first luminance compensation information further includes: obtaining the list of the first luminance compensation information from a volatile memory of the display device.

12. The apparatus according to claim 11, wherein the computer program instructions, when being executed by at least one of the processors, further perform the processes of:

reading the list of first luminance compensation information from a non-volatile memory of the display device to the volatile memory before obtaining the list of first luminance compensation information from the volatile memory of the display device.

13. A non-transitory computer readable storage media having computer program instructions stored thereon, wherein the instructions, when executed by one or more processors, cause the processors to perform steps of:

obtaining a list of first luminance compensation information of the display device set in advance;

regenerating target luminance compensation information for all pixels of the display device based on the list of the first luminance compensation information; and performing luminance compensation on an input image according to the target luminance compensation information for all the pixels of the display device, wherein the list of the first luminance compensation information is set in advance by dividing all the pixels of the display device into groups, calculating average value of initial luminance compensation information of all pixels in the group of pixels as an average luminance compensation information of the group of pixels, and forming the list of the first luminance compensation information by employing the average luminance compensation information of each group of pixels, wherein the initial luminance compensation information of each of the pixels of the display device is a gray level compensation quantity or a compensation coefficient predetermined based on a test luminance value and a target luminance value of the pixel under a test pattern, and wherein said regenerating target luminance compensation information for all pixels of the display device based on the list of the first luminance compensation information comprises:

for each group of pixels, using same target luminance compensation information for respective pixel in the group, wherein the same target luminance compensation information is the average luminance compensation information of the group of pixels.

14. The non-transitory computer readable storage media according to claim 13, wherein said dividing all the pixels of the display device into groups comprises:

dividing every four adjacent pixels of the display device into one group.

15. The non-transitory computer readable storage media according to claim 13, wherein said obtaining the list of first luminance compensation information comprises:

obtaining the list of first luminance compensation information from a volatile memory of the display device.

16. The non-transitory computer readable storage media according to claim 15, wherein said obtaining the list of first luminance compensation information further comprises:

reading the list of first luminance compensation information from a non-volatile memory of the display device to the volatile memory before obtaining the list of first luminance compensation information from the volatile memory of the display device.

* * * * *